US008511508B1

(12) United States Patent
Glover

(10) Patent No.: US 8,511,508 B1
(45) Date of Patent: Aug. 20, 2013

(54) POCKET-ENGAGING CASE

(76) Inventor: George M. Glover, Brooksville, FL (US)

( * ) Notice: Subject to any disclaimer, the term of this patent is extended or adjusted under 35 U.S.C. 154(b) by 40 days.

(21) Appl. No.: 13/169,555

(22) Filed: Jun. 27, 2011

Related U.S. Application Data

(60) Provisional application No. 61/358,677, filed on Jun. 25, 2010.

(51) Int. Cl.
*A45F 5/02* (2006.01)
*A45C 13/18* (2006.01)

(52) U.S. Cl.
USPC ..... 220/729; 150/133; 150/134; 224/230

(58) Field of Classification Search
USPC ..... 224/182, 194, 230; 220/729, 477, 220/629; 150/133, 134
See application file for complete search history.

(56) References Cited

U.S. PATENT DOCUMENTS 1,121,465 A * 12/1914 Brown ..... 24/3.5
1,610,382 A * 12/1926 Jeffries ..... 24/3.5
2,891,592 A * 6/1959 Vaca ..... 150/134
3,142,876 A * 8/1964 Roberts ..... 24/3.5
3,462,801 A * 8/1969 Bortle ..... 24/3.5
4,194,271 A * 3/1980 Hamilton ..... 24/3.5
4,241,476 A * 12/1980 Christenson et al. ..... 24/3.5
4,355,440 A * 10/1982 Johansson et al. ..... 24/3.5
5,244,023 A * 9/1993 Spies ..... 150/134
5,579,817 A * 12/1996 Mader ..... 150/134
7,921,890 B2 * 4/2011 Ho ..... 150/147

* cited by examiner

*Primary Examiner* — Mickey Yu
*Assistant Examiner* — Niki Eloshway
(74) *Attorney, Agent, or Firm* — Ronald E. Smith; Smith & Hopen, P.A.

(57) ABSTRACT

A case for eyeglasses or other articles includes a pair of catches with each catch mounted to an opposite side of the case near its upper end. Elongate, flexible latches are also mounted on opposite sides of the case in cooperative alignment with the respective catches. Each latch includes a base secured to the case and a pocket-gripping member at its distal free end. Each latch is inherently biased outwardly from the case so that the pocket-gripping members engage opposite sides of a shirt or blouse pocket interior when the invention is in use, preventing the case from falling from the pocket when a user bends over. The latches are manually squeezed when in their deployed configuration to place them into their stored, catch-engaging configuration. The latches are manually removed from the catches to deploy them into their pocket-engaging configuration.

1 Claim, 2 Drawing Sheets

POCKET-ENGAGING CASE

CROSS-REFERENCE TO RELATED APPLICATIONS

This application is a non-provisional application of provisional application No. 61/358,677 of the same title filed on Jun. 25, 2010 by the same inventor and claims priority thereto. Said provisional application is incorporated herein by reference.

BACKGROUND OF THE INVENTION

1. Field of the Invention

This invention relates, generally, to cases that hold articles. More particularly, it relates to a case that releasably engages a shirt pocket.

2. Description of the Prior Art

Many people place eyeglasses or other articles in their shirt or blouse pocket but such is inadvisable because the articles are subject to breakage when not properly stored in a protective case.

Prudent eyeglass wearers store their glasses in eyeglass cases and place the eyeglass case in their shirt or blouse pocket. This protects the glasses against breakage but the case often slides out of the pocket when the person bends over.

Similar breakable articles should also be placed into a suitable protective case when carried in a pocket.

Thus there is a need for a case that does not side out of a shirt or blouse pocket when a user of an eyeglass case or a case for another personal article bends over.

However, in view of the art considered as a whole at the time the present invention was made, it was not obvious to those of ordinary skill in the art how the identified need could be fulfilled.

SUMMARY OF THE INVENTION

The long-standing but heretofore unfulfilled need for an improved means for retaining a case in a shirt or blouse pocket is now met by a new, useful, and non-obvious invention.

The novel case for holding articles includes a bottom wall, a sidewall mounted about the periphery of the bottom wall and projecting upwardly therefrom, an open end forming an opening that receives an article, a pair of catches mounted to an exterior surface of the sidewall in opposed relation to one another, a pair of elongate, flexible latches mounted to the bottom wall in opposed relation to one another in cooperative alignment with the pair of catches, and a pocket-gripping means mounted to each latch of the pair of latches at a distal free end of each latch.

Each latch of the pair of latches is biased away from the case so that each pocket-gripping means is spaced apart from the sidewall when in a position of repose.

When a latch is manually released from its associated catch, the inherent bias of the latch deploys it into a pocket-gripping operative position. The pocket-gripping means are spaced transversely apart from one another by a distance that exceeds the width of a shirt pocket when the latches are released from their associated catches and are in a position of repose.

The pocket-gripping means therefore engage opposite sides of a shirt or blouse pocket, thereby preventing the case and its contents from falling from the pocket when a user bends over or otherwise inverts the shirt pocket.

The pocket-gripping means has a high friction surface for gripping the interior of a shirt pocket.

In a first embodiment, each catch of the pair of catches includes confronting parts formed of a resilient material that collectively form a latch-receiving opening and that confront one another at their respective free ends in spaced apart relation from the sidewall. A latch enters into engagement with an associated catch when the confronting parts are momentarily displaced to allow entry of each latch into its associated latch-receiving opening and a latch exits from its associated catch when the confronting parts are momentarily displaced to allow exit of each latch from its associated latch-receiving opening.

Each latch of the pair of latches has a deployed configuration and a stored configuration and is changed from its deployed configuration to its stored configuration when the bias is manually overcome.

In an alternative embodiment, each catch is formed of a single part that is connected to the sidewall and has multiple bends formed therein to form a substantially enclosed space. The substantially enclosed space is closed on three sides and partially open on a fourth side to admit a latch that follows a path of travel into the substantially enclosed space when manipulated.

The primary object of this invention is to provide a case for eyeglasses and other articles that locks itself inside a shirt or blouse pocket so that the case does not fall out when the pocket is held horizontally or in a downwardly inclined position.

Another important object is to accomplish the foregoing object with a latch and catch means that is manually operated so that no substantial amount of time is required to deploy or retract a shirt pocket gripping means.

These and other important objects, advantages, and features of the invention will become clear as this description proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the nature and objects of the invention, reference should be made to the following detailed disclosure, taken in connection with the accompanying drawings, in which.

DETAILED DESCRIPTION OF THE PREFERRED EMBODIMENT

Figure 1:
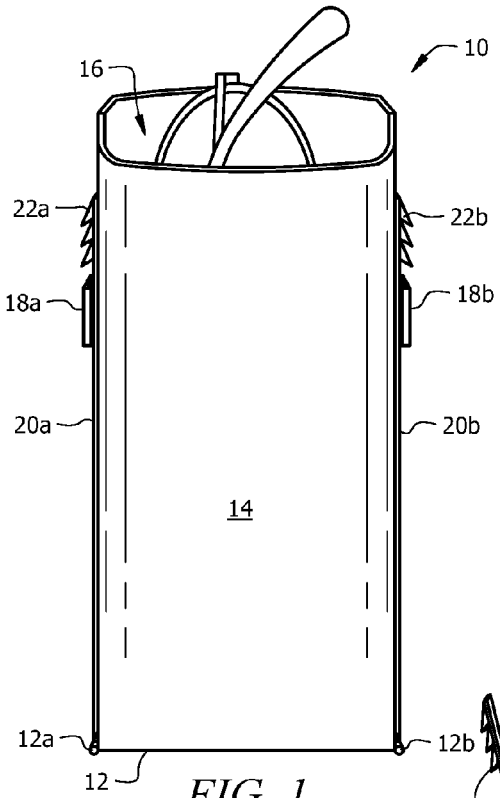
FIG. 1 is a front perspective view of a preferred embodiment of the invention when the novel latches are in their stored configuration.

FIG. 1 depicts an illustrative embodiment of the novel case which is denoted as a whole by the reference numeral 10. A pair of eyeglasses is depicted within said case. However, the novel case has utility in connection with any article that can be contained within it so in a generic sense the novel case is a holder for articles in general without limitation to eyeglasses.

Case 10 includes imperforate bottom wall 12 having a generally oval shape in the depicted, preferred embodiment.

Sidewall 14 is mounted about the periphery of bottom wall 12 and projects upwardly therefrom. Open end 16 forms a generally oval-shaped opening that receives a pair of eyeglasses in the well-known way. The shape of bottom wall 12 is not limited to an oval shape and may have any practical geometric configuration. Nor is the invention limited to an oval-shaped open end and therefore the cross-sectional configuration of sidewall 14 need not be oval.

Catches 18*a*, 18*b* are integrally formed with or fixedly secured to sidewall 14, preferably closer to open end 16 than bottom wall 12 as depicted. The exact locations of catches 18*a*, 18*b* along the height extent of case 10 are not critical. The location of each catch is where the curvature of sidewall 14 is highest, i.e., each catch is positioned at a bight area of sidewall 14.

Elongate, flexible latches 20*a*, 20*b* are mounted as at 12*a*, 12*b* on opposite sides of bottom wall 12, also in a bight area so as to be in cooperative alignment with catches 18*a*, 18*b*, respectively.

Each latch includes a pocket-gripping means 22*a*, 22*b* at its distal free end. The distance between each base 12*a*, 12*b* and its associated catch 18*a*, 18*b* must be less than the distance from each base to its associated pocket-gripping means.

Each latch 20*a*, 20*b* is inherently biased away from case 10 so that each pocket-gripping means 22*a*, 22*b* is spaced apart from sidewall 14 when in repose as depicted in FIG. 2. Accordingly, when a latch is manually pulled from its associated catch, the inherent bias of the latch deploys it into a pocket-gripping operative position as perhaps best understood in connection with FIG. 3. The position of repose of the deployed latches 20*a*, 20*b* places pocket-gripping means 22*a*, 22*b* transversely apart from one another by a distance that exceeds the width of a shirt pocket.

Pocket-gripping means 22*a*, 22*b* are depicted as having a saw-tooth configuration because such configuration does a good job of gripping fabric. However, there are many well-known variations of saw-tooth configurations and all of them are within the scope of this invention. For example, the pocket-gripping means may also be knurled or otherwise roughened to provide a high friction grip with the interior of a shirt pocket.

Figure 2B:
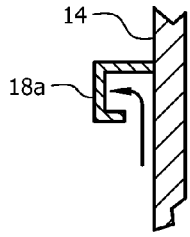
FIG. 2B is a sectional view taken along line 2B-2B in FIG. 2A.
Figure 2A:
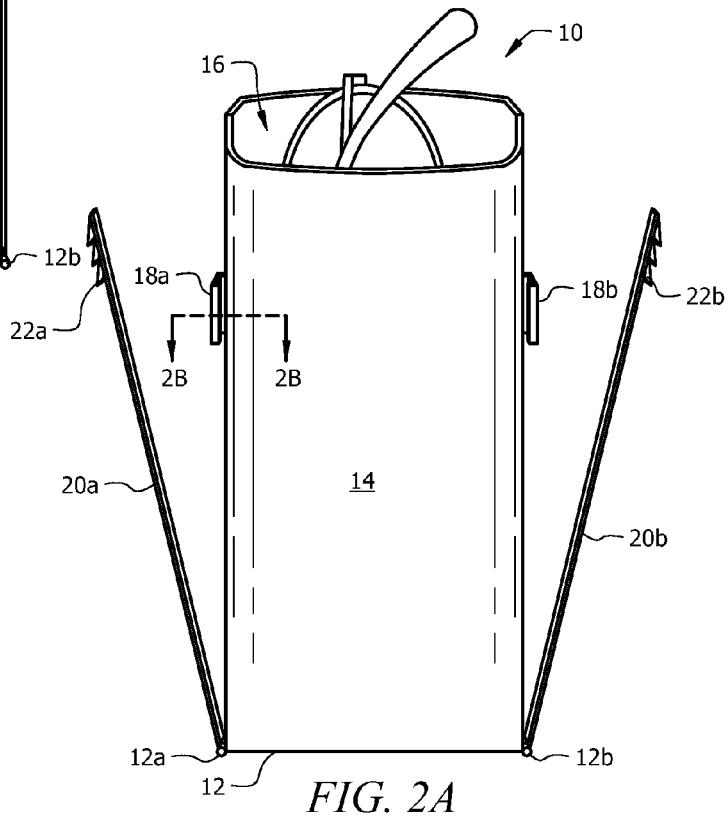
FIG. 2A is a is a front perspective view of a preferred embodiment of the invention when the novel latches are in their deployed configuration.
Figure 3:
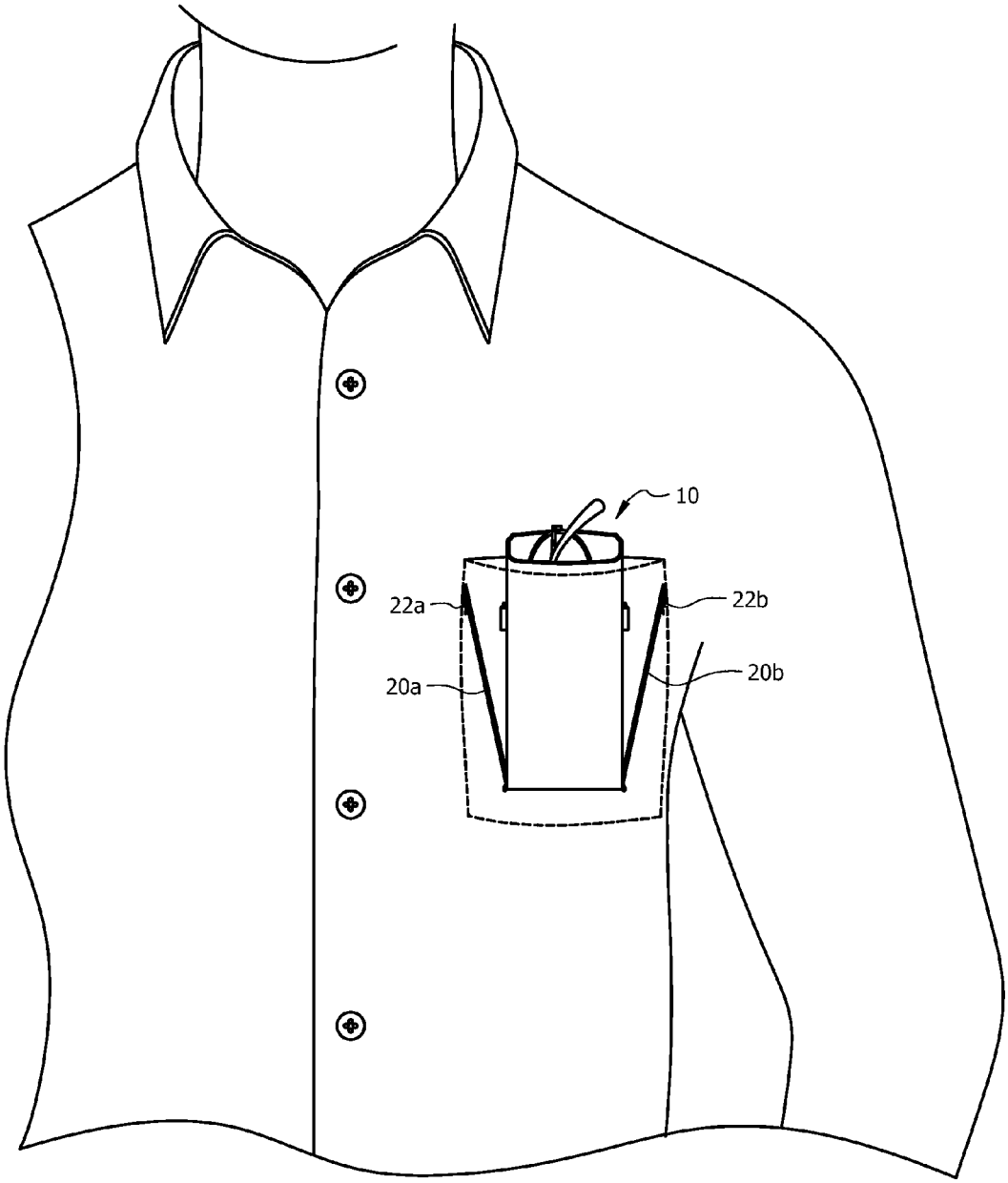
FIG. 3 is a front perspective view of the invention when operatively deployed in a shirt pocket.

Flexible latches 20*a*, 20*b* are disposed in their respective storage positions in FIG. 1 and in their respective deployed positions in FIGS. 2A and 3.

As depicted in FIG. 3, pocket-gripping means 22*a*, 22*b* engage opposite sides of a shirt pocket when the invention is in use, thereby preventing case 10 and its contents from falling from a shirt pocket when a user bends over or otherwise inverts the shirt pocket.

There are multiple suitable structures for each catch 18*a*, 18*b*. For example, each catch may be formed of two confronting parts formed of a slightly resilient material that collectively form a latch-receiving opening and that confront one another at their respective free ends in spaced apart relation from sidewall 14. Latches 20*a*, 20*b* are manually squeezed when in their deployed configuration to place them into their stored configuration. The two confronting ends of each catch 18*a*, 18*b* are momentarily displaced apart from one another when the latches enter into the opening formed by said confronting parts and said confronting ends again return to their respective positions of repose under their inherent bias after entry of said latches into their respective openings. The latches are manually pulled from their openings or enclosures to deploy them into their respective operative configurations.

In the preferred embodiment, depicted in the Figures, each catch is formed of a single part that is connected to sidewall 14 at its base and that is bent multiple times as best depicted in FIG. 2B to form a space closed on three sides and partially open on a fourth side to admit a latch that follows a path of travel into a substantially enclosed space as indicated by the arrow in said FIG. 2B.

The latches are squeezed and guided into their respective openings and released so that the inherent bias of each latch retains it within its associated catch when each latch is in its stored configuration so that case 10 can be removed from a shirt or blouse pocket. The flexibility of a shirt or blouse pocket enables the latches to be squeezed toward one another while case 10 is in such a pocket.

The latches are squeezed toward one another and guided out of their respective openings and released so that the inherent bias of each latch deploys its pocket-gripping free end against the interior of a shirt pocket when the case is in its deployed configuration.

Eyeglasses or other articles inside case 10 may be removed from case 10 and reinserted thereinto while latches 20*a*, 20*b* remains in their respective operative configurations.

It will thus be seen that the objects set forth above, and those made apparent from the foregoing disclosure, are efficiently attained and since certain changes may be made in the above construction without departing from the scope of the invention, it is intended that all matters contained in the foregoing disclosure or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A case for holding articles, comprising:

a bottom wall;

a sidewall mounted about the periphery of said bottom wall and projecting upwardly therefrom;

an open end forming an opening that receives an article;

a pair of catches mounted to said sidewall in opposed relation to one another;

a pair of elongate, flexible latches mounted to said bottom wall in opposed relation to one another in cooperative alignment with said pair of catches;

a pocket-gripping means mounted to each latch of said pair of latches at a distal free end of each latch;

each latch of said pair of latches being biased away from said case so that each pocket-gripping means is spaced apart from said sidewall when in a position of repose so that when a latch is manually pulled from its associated catch, an inherent bias of the latch deploys it into a pocket-gripping operative position, said position of repose of the deployed latches placing said pocket-gripping means transversely apart from one another by a distance that exceeds the width of a shirt pocket;

said pocket-gripping means having a high friction surface for gripping the interior of said shirt pocket;

each latch of said pair of latches having a deployed configuration and a stored configuration;

each latch being changed from its deployed configuration to its stored configuration when said inherent bias is manually overcome;

said pocket-gripping means engaging opposite sides of said shirt pocket, thereby preventing said case and its contents from falling from said shirt pocket when a user bends over or otherwise inverts the shirt pocket;

each catch of said pair of catches including abutting parts formed of a resilient material that collectively enclose a latch-receiving opening and that confront one another at their respective free ends in spaced apart relation from said sidewall;

each latch entering into engagement with an associated catch when said confronting parts are momentarily displaced to allow entry of each latch into its associated latch-receiving opening;

each latch exiting from its associated catch when said confronting parts are momentarily displaced to allow exit of each latch from its associated latch-receiving opening;

each catch of said pair of catches being formed of a single part that is connected to said sidewall; and each catch having multiple bends formed therein to form a substantially enclosed space, said substantially enclosed space being closed on three sides and partially open on a fourth side to admit a latch that follows a path of travel into said substantially enclosed space.

* * * * *